US007147347B1

(12) United States Patent
Khachakian

(10) Patent No.: US 7,147,347 B1
(45) Date of Patent: Dec. 12, 2006

(54) FLASHING LIGHT CABLE

(76) Inventor: Norire Khachakian, 1208 Alameda, Glendale, CA (US) 91201

( * ) Notice: Subject to any disclaimer, the term of this patent is extended or adjusted under 35 U.S.C. 154(b) by 0 days.

(21) Appl. No.: 10/937,696

(22) Filed: Sep. 9, 2004

(51) Int. Cl.
*F21L 4/02* (2006.01)

(52) U.S. Cl. ..... 362/227; 362/806; 362/653

(58) Field of Classification Search ..... 174/110 R, 174/112, 117 R; 362/227, 806, 652, 653, 362/654, 640, 234, 249, 391; 84/464 A, 84/464 R; 381/118, 77, 124
See application file for complete search history.

(56) References Cited

U.S. PATENT DOCUMENTS

| | | | | |
|---|---|---|---|---|
| 2,473,199 | A * | 6/1949 | Garcia | 84/464 R |
| 3,324,755 | A * | 6/1967 | Canonico | 84/267 |
| 4,812,956 | A * | 3/1989 | Chen | 362/249 |
| 6,283,612 | B1 | 9/2001 | Hunter | 362/240 |
| D462,324 | S | 9/2002 | Feucht | D13/133 |
| 6,497,659 | B1 | 12/2002 | Rafert | 600/331 |
| 6,840,655 | B1 * | 1/2005 | Shen | 362/249 |

OTHER PUBLICATIONS

Derwent-Acc-N2795D, Dec. 10, 1981, Shock pulse monitoring bearings condition-has transistorised circuit turning on the LED when audio signal is present.*

* cited by examiner

*Primary Examiner*—Sandra O'Shea
*Assistant Examiner*—Sharon Payne
(74) *Attorney, Agent, or Firm*—Peter Ganjian

(57) ABSTRACT

A flashing light cable for electrically connecting a musical instrument or a microphone to an amplifier or to a sound system, for use by an entertainer to enhance the visual appeal of a stage performance. The cable comprises two jacks having an elongated cable portion extending therebetween. The cable portion comprises a conductive wire in electrical communication with each of the jacks, and a plastic insulation that sheathes the conductive wire. The plastic insulation has a plurality of spatially separated flashing light bulbs partially embedded therein. When the cable is used to electrically connect two pieces of electrical equipment, and when the equipment is selectively activated, current flows through the cable, thereby causing the light bulbs to be selectively and intermittently illuminated, and enhancing the visual appeal of a stage performance by the entertainer.

4 Claims, 2 Drawing Sheets

FLASHING LIGHT CABLE

BACKGROUND OF THE INVENTION

1. Field of the Invention

The invention generally relates to a cable for electrically connecting a musical instrument or a microphone to an amplifier or to a sound system, and in particular relates to such a cable having a plurality of selectively flashing light bulbs embedded along the length of the cable, for use by an entertainer for enhancing the visual appeal of a stage performance.

2. Description of the Related Art

Entertainers such as musicians and deejays provide stage performances to audiences worldwide. In addition to musically entertaining an audience, these entertainers must also visually enthrall the audience, because the visual aspect is an integral part of the performance, and because an audience that is not visually engaged by a show may lose interest in the music as well. Cables are used by many stage performers for electrically connecting a musical instrument or a microphone to an amplifier or to a sound system, and are a ubiquitous presence at many performances. However, existing cables generally do nothing for, and may even tend to detract from, the visual appeal of the performance. Accordingly, there is a need for a cable having a plurality of selectively flashing light bulbs embedded along the length of the cable, for enhancing the visual appeal of a stage performance by an entertainer, and for more greatly involving the audience in the music as well.

A variety of electric cable devices have been invented. For example, U.S. Pat. No. 6,283,612 to Hunter appears to show a light strip having diodes mounted on a printed circuit board disposed within a transparent or translucent tube. Additionally, U.S. Pat. No. 6,497,659 to Rafert appears to show a system for identifying a cable transmitting a signal from a sensor to an electronic instrument. Moreover, U.S. Pat. No. D462,324 to Feucht appears to show an ornamental design for an enclosure for a speaker cable connector.

While these devices may be suitable for the particular purpose employed, or for general use, they would not be as suitable for the purposes of the present invention as disclosed hereafter.

SUMMARY OF THE INVENTION

It is an object of the invention to provide a cable for electrically connecting a musical instrument or a microphone to an amplifier or to a sound system, and for enhancing the visual appeal of a stage performance by an entertainer. Accordingly, the cable has an elongated cable portion having a plastic insulation layer having a plurality of spatially separated flashing light bulbs partially embedded therein. When current flows through the cable, the light bulbs are selectively and intermittently illuminated, and thereby enhance the visual appeal of a stage performance by the entertainer.

Further objects of the invention will become apparent in the detailed description of the invention that follows.

The invention is a flashing light cable for electrically connecting a musical instrument or a microphone to an amplifier or to a sound system, for use by an entertainer to enhance the visual appeal of a stage performance. The cable comprises two jacks having an elongated cable portion extending therebetween. The cable portion comprises a conductive wire in electrical communication with each of the jacks, and a plastic insulation that sheathes the conductive wire. The plastic insulation has a plurality of spatially separated flashing light bulbs partially embedded therein. When the cable is used to electrically connect two pieces of electrical equipment, and when the equipment is selectively activated, current flows through the cable, thereby causing the light bulbs to be selectively and intermittently illuminated, and enhancing the visual appeal of a stage performance by the entertainer.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
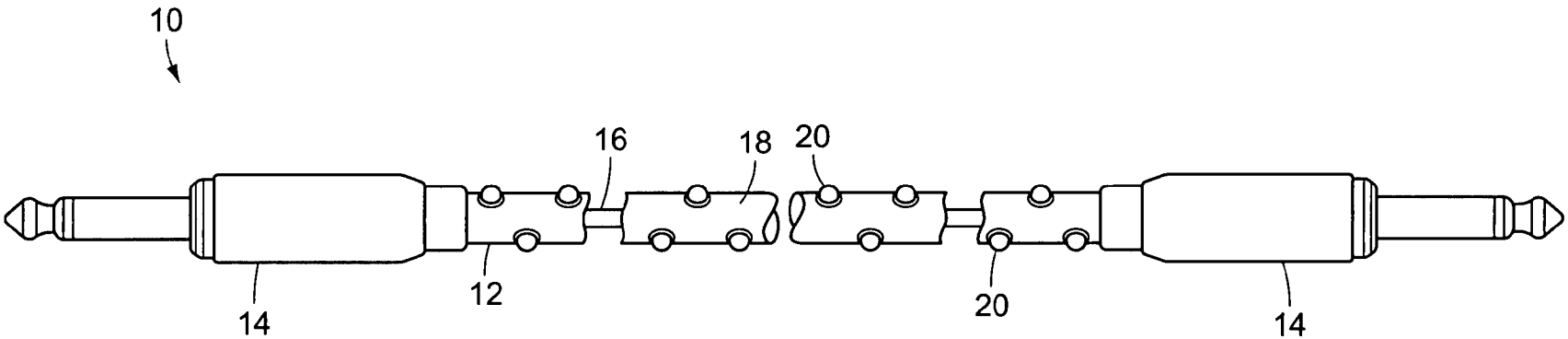
FIG. 1 is an elevational view of a flashing light cable according to the present invention, wherein portions of a plastic insulation layer have been broken away to reveal a conductive wire contained therein.

FIG. 1 illustrates a flashing light cable 10, for electrically connecting a musical instrument or a microphone to an amplifier or to a sound system, and for enhancing the visual appeal of a stage performance by an entertainer. The flashing light cable 10 comprises two jacks 14 having an elongated cable portion 12 extending therebetween. The cable portion 12 comprises a conductive wire 16 in electrical communication with each of the jacks 14, and a plastic insulation layer 18 that sheathes the conductive wire 16.

The plastic insulation layer 18 has a width having a plurality of small, spatially separated flashing light bulbs 20 partially embedded therein, each in electrical communication with one another in a manner analogous to a string of blinking Christmas light bulbs, and also in electrical communication with the two jacks 14. Prior to a stage performance, each of the jacks 14 is selectively plugged into an electrical receptacle of a different piece of electronic equipment, in order to electrically connect the equipment. When the user selectively activates the electronic equipment, current flows through the cable 10, and thereby activates the light bulbs 20 to be selectively and intermittently illuminated, thereby enhancing the visual appeal of the stage performance.

Figure 2:
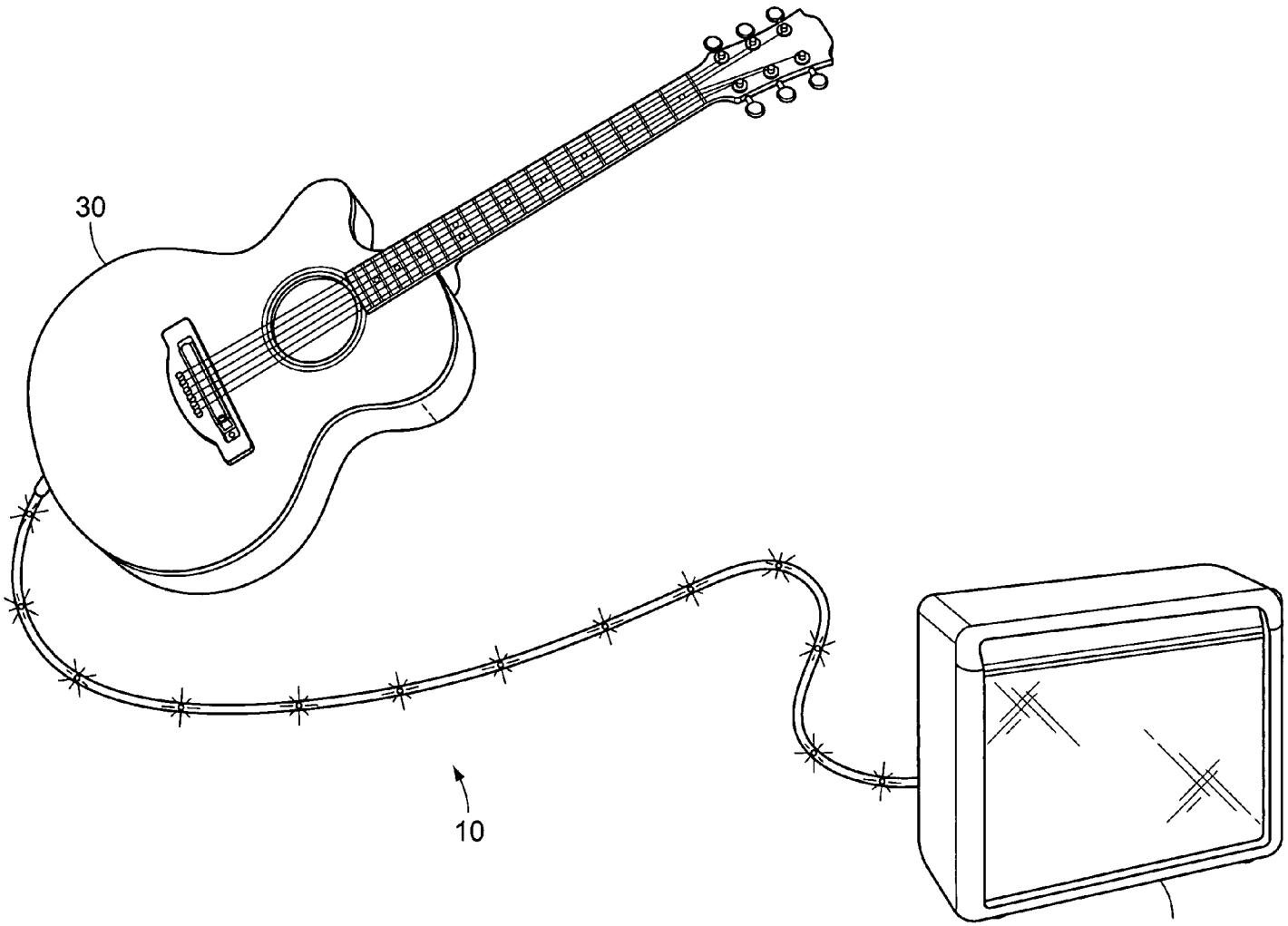
FIG. 2 is a perspective view of the flashing light cable being used to electrically connect an existing electric guitar with an existing amplifier.

FIG. 2 illustrates the flashing light cable 10 being used to electrically connect an existing electric guitar 30 with an existing amplifier 32.

A variety of mechanisms well known in the relevant arts may be employed to actuate the plurality of light bulbs 20 to intermittently "blink". For example, one of the plurality of light bulbs 20 might be a "control bulb" which contains a bimetallic strip which selectively bends in one direction when heated and which selectively bends in an opposing direction when cooled. In such an embodiment, the user electrically connects two pieces of electronic equipment with the cable 10 and activates the equipment, generally with an existing activation switch provided for this purpose, thereby causing current to flow within the cable 10 and causing the plurality of light bulbs 20 to be illuminated. Heat emitted by the illuminated control bulb causes the bimetallic strip to bend, thereby breaking the circuit and preventing the other light bulbs 20 from being illuminated. As the strip cools, it bends back, thereby once again illuminating the control bulb, and causing all the other light bulbs 20 to simultaneously be illuminated. Alternately, a mechanism for selectively illuminating some of the light bulbs 20 at different times from other light bulbs 20 may be employed within the cable 10. A variety of such mechanisms are also well known in the relevant arts.

The cable 10 is provided in a variety of different lengths, in order that the cable 10 may be suitably used for a variety of differing applications. Each of the plurality of light bulbs 20 has a color. The colors may include red, green, orange, white, yellow, and other colors. The light bulbs 20 are preferably 2.5 Volts and do not emit enough heat to warp or otherwise damage the plastic insulation layer 18 in which they are embedded. It is contemplated that each of the light bulbs 20 may be selectively threaded within a different electrical socket, from which they may be selectively removed when the light bulbs 20 "burn out" after a period of time. In an alternate embodiment, the entire cable 10 may be discarded and replaced with a new cable 10 when the light bulbs 20 start to "burn out".

In conclusion, herein is presented a cable having a plurality of selectively flashing light bulbs embedded along the length of the cable, for use by an entertainer during a stage performance to enhance the visual appeal of the stage performance. The invention is illustrated by example in the drawing figures, and throughout the written description. It should be understood that numerous variations are possible, while adhering to the inventive concept. Such variations are contemplated as being a part of the present invention.

What is claimed is:

1. An entertainment device, comprising:

a flashing light musical instrument cable for enhancing the visual appeal of a stage performance having:

two electrical audio jack male connectors;

an elongated cable portion extending between the two electrical audio jack male connectors that electrically connect two different pieces of electronic audio equipment for transmitting electrical audio signals, each piece of electronic audio equipment having an electrical receptacle;

said elongated cable portion comprising:

a conductive wire in electrical communication with each of the electrical audio jack male connectors to transmit electrical audio signals; and a plastic insulation layer that sheaths the conductive wire, wherein the plastic insulation layer has a width having a plurality of spatially separated light bulbs partially embedded therein, each of the light bulbs in electrical communication with one another and with the two electrical audio jack male connectors; and wherein during use, each of the electrical audio jack male connectors is selectively plugged into the electrical receptacle of a different piece of electronic audio equipment to allow current to flow through the conductive wire of the elongated cable portion;

the current activating the light bulbs to be selectively and intermittently illuminated, thereby enhancing the visual appeal of the stage performance while transmitting electrical audio signals to the connected electronic audio equipment.

2. The flashing light musical instrument cable as recited in claim 1, wherein some of the light bulbs blink at different times than other light bulbs.

3. The flashing light musical instrument cable as recited in claim 1, wherein the plurality of light bulbs simultaneously intermittently blink.

4. A method for entertainment, comprising the acts of:

providing an elongated flashing light musical instrument cable having a conductive wire;

coupling two ends of the elongated flashing light musical instrument cable to two electrical audio jack male connectors;

insulating the conducive wire by providing a plastic insulation layer that sheaths the conductive wire;

providing a plurality of spatially separated light bulbs partially embedded within a width of the plastic insulation layer, each of the light bulbs in electrical communication with one another and with the two electrical audio jack male connectors;

plugging the electrical audio jack male connectors into an electrical receptacle of different piece of electronic audio equipment to allow current to flow through the conductive wire of the elongated flashing light musical instrument cable, with the current activating the light bulbs to be selectively and intermittently illuminated, thereby enhancing the visual appeal of the stage performance while transmitting electrical audio signals to the connected electronic audio equipment.

* * * * *